US011594154B1

(12) United States Patent
Lickteig et al.

(10) Patent No.: US 11,594,154 B1
(45) Date of Patent: Feb. 28, 2023

(54) FOLDABLE PRESENTATION PORTFOLIO SYSTEM

(71) Applicant: TARGET BRANDS, INC., Minneapolis, MN (US)

(72) Inventors: Lori Lickteig, Minneapolis, MN (US); Jeremy A. Clark, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 17/499,661

(22) Filed: Oct. 12, 2021

(51) Int. Cl.
*G09F 7/18* (2006.01)

(52) U.S. Cl.
CPC ..... *G09F 7/18* (2013.01); *G09F 2007/1852* (2013.01); *G09F 2007/1856* (2013.01)

(58) Field of Classification Search
CPC . A45C 2007/0013; A45C 9/00; A47F 7/0042; A47F 5/10; G09F 15/0062
See application file for complete search history.

(56) References Cited

U.S. PATENT DOCUMENTS 371,699 A * 10/1887 Morris ..... A45C 9/00 190/8
2,076,683 A 4/1937 Tharp
2,975,539 A * 3/1961 Anderson ..... G09F 15/0062 40/621
3,424,283 A * 1/1969 Sheldon ..... A45C 9/00 190/11
4,314,635 A 2/1982 Fraser et al.
4,403,554 A * 9/1983 Valentine ..... A47F 5/10 248/165
4,475,650 A * 10/1984 De Fazio, Jr. ..... B43L 13/005 312/231
4,711,046 A 12/1987 Herrgord
4,712,673 A 12/1987 Moore
(Continued)

OTHER PUBLICATIONS

"All Black 3 ¾" Thick Folding Pegboard Display Suitcase", printed from www.walmart.com/ip/All-Black-3-3-4-Thick-Folding-Pegboard-Display-Suitcase/718716393, publicly available at least as early as Mar. 31, 2020 (2 pages).
(Continued)

*Primary Examiner* — David R Dunn
*Assistant Examiner* — Christopher E Veraa
(74) *Attorney, Agent, or Firm* — Griffiths & Seaton PLLC; JoAnn M. Seaton

(57) ABSTRACT

A presentation portfolio includes a first panel, a second panel, a binding member, and a locking member. The first panel defines an interior surface and a longitudinal edge extending along a side of its interior surface. The second panel defines an interior surface and a longitudinal edge extending along a side of its interior surface. The binding member rotatably couples the first panel with the second panel such that the presentation portfolio is movable between an open orientation and a closed orientation. The locking member is initially slidably coupled to first panel by receiving a portion of the longitudinal edge of the first panel within an elongated channel thereof. When the presentation portfolio is in the open orientation, the locking member is slidable between an unsecured position and a secured position in a manner selectively securing the first panel and the second panel adjacent one another.

20 Claims, 11 Drawing Sheets

(56) References Cited

U.S. PATENT DOCUMENTS

| | | | | | |
|---|---|---|---|---|---|
| 4,893,711 | A * | 1/1990 | Gustafson | A45C 9/00 | 217/11 |
| 4,949,490 | A | 8/1990 | Miller | | |
| 5,036,973 | A | 8/1991 | Aida | | |
| 5,110,219 | A * | 5/1992 | Lopes | A45C 9/00 | 5/419 |
| 5,611,384 | A * | 3/1997 | Carter | G09F 15/0068 | 52/282.1 |
| 5,720,464 | A * | 2/1998 | Meinscher | A47F 7/146 | 248/447 |
| 6,189,594 | B1 * | 2/2001 | Carter | A45C 9/00 | 160/135 |
| 6,578,706 | B2 | 6/2003 | Thompson | | |
| 6,626,303 | B1 | 9/2003 | Moodie | | |
| 7,287,751 | B2 * | 10/2007 | Webber, Jr. | A63F 3/00694 | 273/287 |
| 7,306,263 | B2 | 12/2007 | Hudson | | |
| 7,441,358 | B1 * | 10/2008 | Ngan | G09F 1/10 | 40/610 |
| 7,487,871 | B1 | 2/2009 | Bellofatto, Jr. et al. | | |
| 8,038,052 | B2 | 10/2011 | Huang | | |
| 8,893,881 | B2 | 11/2014 | Schneider | | |
| 2003/0183348 | A1 * | 10/2003 | Carter | A45C 9/00 | 160/135 |

OTHER PUBLICATIONS

"Displays2go 3-Panel Tabletop Display Board", printed from www.amazon.com/Displays2go-3-Panel-Tabletop-Display-30-Inches/dp/B00627OMPO, publicly available at least as early as Nov. 1, 2011 (8 pages).

"50"w Tabletop Hook & Loop Display Board", printed from www.displays2go.com/P-1121/Foldable-Briefcase-Display-48-x-24-Self-Contained, publicly available at least as early as Mar. 31, 2020 (3 pages).

* cited by examiner

FOLDABLE PRESENTATION PORTFOLIO SYSTEM

BACKGROUND OF THE INVENTION

Display systems including substantially vertically orientated panels for supporting papers, samples, and other items for display, for example, at sales presentations, press conferences, conventions, seminars, client or peer review, student presentations, etc. for a variety of reasons. Such display systems may be formed of a single panel, or two or more panels coupled to one another, which is ideal for display, but can often be cumbersome to transport between home, office, presentation area, school, etc. especially without losing item secured to said panels for display.

In other or related arenas, portfolio folders exist having side panels, etc. to hold items inside more securely during storage and transport. However, such folders typically do not assist in presenting the display for review and/or in holding items in a secured position relative to fronts of back of the portfolio folders. As such, many times users place items in a portfolio folder, box, bag, or other transportation container and for transportation and, later, secures such items to presentation boards at the place of desired display. At times, the disassembly and reassembly of portfolio displays each time a display is made provides wearing or damage of the items and takes valuable time. In some instances, very little time is afforded for reassembly of a display, which is more likely to result in a less than ideal or less aesthetically pleasing manner to observers of the display than would otherwise be desired.

SUMMARY

One aspect of the present invention relates to a presentation portfolio including a first panel, a second panel, a binding member, and a locking member. The first panel is substantially planar and defines a first panel interior surface and a first panel longitudinal edge extending along a side of the first panel interior surface. The second panel is substantially planar and defines a second panel interior surface and a second panel longitudinal edge extending along a side of the second panel interior surface. The binding member rotatably couples the first panel with the second panel such that the presentation portfolio is movable between an open orientation, in which the first panel and the second panel are positioned to be coplanar with one another, and a closed orientation, in which the first panel and the second panel are stacked on one another such that the first panel interior surface faces the second panel interior surface. The locking member defines a first end, a second end opposite the first end, and an elongated channel extending between and through the first end and the second end. The locking member is initially slidably coupled to first panel by receiving a first portion of the first panel longitudinal edge within the elongated channel. When the presentation portfolio is in the open orientation, the locking member is slidable between an unsecured position, in which the locking member maintains the first portion of the first panel longitudinal edge and is spaced entirely from the second panel, and a secured position, in which the elongated channel maintains a second, smaller portion of the first panel longitudinal edge and a first portion of the second panel longitudinal edge of the second panel where the second panel longitudinal edge linearly aligns with the first panel longitudinal edge, in a manner selectively securing the first panel and the second panel adjacent one another. Other portfolios, portfolio systems, transport folders, or similar systems and methods of use are also disclosed herein.

BRIEF DESCRIPTION OF THE DRAWINGS

Embodiments of the invention will be described with respect to the figures, in which like reference numerals denote like elements, and in which.

DETAILED DESCRIPTION

Figure 1:
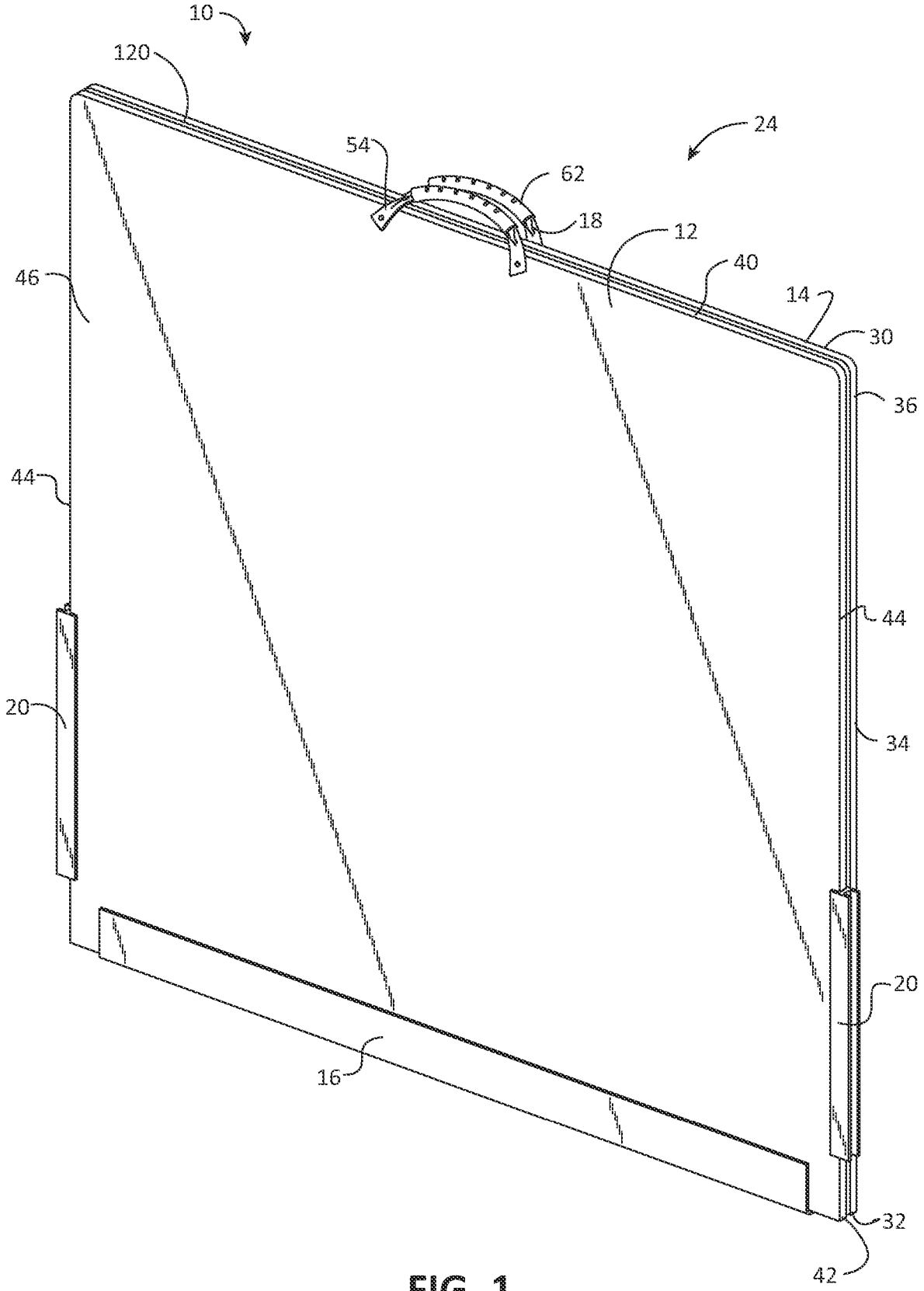
FIG. 1 is a front perspective view illustration of a foldable, presentation portfolio in a folded position, according to one embodiment of the present invention.

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" and "substantially" each applies to all numeric values or descriptive terms, respectively, and generally indicate a range of numbers or characteristics that one of skill in the art would consider equivalent to the recited values or terms, that is, having the same function or results.

A presentation portfolio is configured for use for magnetically and selectively maintaining documents and/or other items thereon both for display, e.g., when propped to a substantially vertical orientation, and upon folding into a storage and transport configuration to collectively form a presentation portfolio system. In this manner, the presentation portfolio allows a user to arrange documents on interior surfaces of the presentation portfolio and magnetically secure the same to the portfolio. The portfolio can then be folded while maintaining the documents in their arranged place for storage and transport. The portfolio can then be reopened at the place of presentation or display and placed back in a substantially vertical presentation without worry that the documents will be lost or moved during transport and without need to arrange and secure the document upon reaching the place of display.

In one embodiment, the presentation portfolio is formed of two planar panels rotably secured to each other along adjacent edges thereof. The two panels are in a substantially coplanar relationship in the open orientation and are rotated toward one another so inside planar surfaces of the two planar panels face each other in the closed orientation. A locking member is slidably secured along a longitudinal edge of only one of the two planar panels. When the presentation portfolio is in the open orientation, the two panels move from an unsecured position with the adjacent edges spaced apart from one another and a secured position with the two panels moved closer together such that the adjacent edges abut each other. In the secured position, the locking member is slidable to a position holding the free longitudinal edges bridging the two planar panels to create one large display surface for displaying documents. Following display, locking member is slid to only interact with one of the two panels, and the two panels are rotated, i.e., folded toward one another substantially enclosing the documents between the two panels and, in one example, further maintain the documents in place via compression. As such, the presentation portfolio, and system the presentation portfolio is a part of, provides one means for transport and display of items to be shown as part of a presentation to observers. Other benefits and features of the system are further described below.

Turning to the figures, FIGS. 1-4 illustrate one embodiment of a presentation portfolio 10 foldable between open and closed positions and including a first panel 12, a second panel 14, a binding member 16, and a locking member 20. First panel 12 and second panel 14 are coupled to and rotatable relative to one another about binding member 16. When presentation portfolio 10 is in an open orientation, locking member 20 slidably and selectively interacts with each of first panel 12 and second panel 14 to either allow first panel 12 and second panel 14 to be spaced apart from each other, e.g., a distance allowed by the binding member 16, in an unsecured position, or to hold first panel 12 and second panel 14 to abut one another and be held in that position by interaction with both the first panel 12 and second panel 14.

In addition, at least one of first panel 12 and second panel 14 include an array of fixed magnets 52 facing an interior surface thereof for use is selectively securing documents 110 (e.g., FIGS. 7 and 8) or other items to the at least one of first panel 12 and second panel 14. More specifically, free magnets 112 are configured to each magnetically couple with each of the array of fixed magnets 52 to hold documents 110 therebetween with sufficient strength that documents 110 remain in place during display, storage, and transport. In one example, a handle 18 is secured to at least one of the first panel 12 and the second panel 14 opposite binding member 16 to facilitate carrying and transport of presentation portfolio 10. Examples of additional features, uses, and benefits are described in detail below.

Referring to FIGS. 1-5, one example of first panel 12 is shown. First panel 12 is substantially planar and formed of a suitable rigid and lightweight material for ease of transportation such as foam core, paperboard, cardboard, plastic board, or other suitable material. First panel 12 defines and extends between a free lateral edge 30, a bound lateral edge 32 opposite first lateral edge 30, and opposite longitudinal edges 34 extending opposite one anther between free lateral edge 30 and bound lateral edge 32. For example, free lateral edge 30 and bound lateral edge 32 extend substantially parallel to one another and the opposite longitudinal edges 34 extending substantially parallel to one another and substantially perpendicularly relative to free lateral edge 30 and bound lateral edge 32. First panel 12 further defines an exterior surface 36 and an interior surface 38, which faces in an opposite direction as exterior surface 36, with both exterior surface 36 and interior surface 38 being bound by free lateral edge 30, bound lateral edge 32, and opposite longitudinal edges 34.

In a similar manner as described with respect to first panel 12, second panel 14 is substantially planar and formed of a suitable rigid and lightweight material for ease of transportation such as foam core, paperboard, cardboard, plastic board, or other suitable material. Second panel 14 defines and extends between a free lateral edge 40, a bound lateral edge 42 opposite first lateral edge 40, and opposite longitudinal edges 44 extending opposite one anther between free lateral edge 40 and bound lateral edge 42. For example, free lateral edge 40 and bound lateral edge 42 extend substantially parallel to one another and the opposite longitudinal edges 44 extending substantially parallel to one another and substantially perpendicularly relative to free lateral edge 40 and bound lateral edge 42. Second panel 14 further defines an exterior surface 46 and an interior surface 48, which faces in an opposite direction as exterior surface 46, with both exterior surface 46 and interior surface 48 being bound by free lateral edge 40, bound lateral edge 42, and opposite longitudinal edges 44.

In one embodiment, one or both of first panel 12 and second panel 14 include the array of fixed magnets 52 facing and/or open to interior surface 38. Each fixed magnet 52, in one example, is circular and has a diameter of between 0.25 inches and 1 inch and is formed of any suitable material providing sufficient strength for maintaining documents 110 (see FIGS. 7 and 8) such as, but not limited to, ceramic, alnico, and neodymium. As shown in the illustrated embodiments, at least one of, and in one example both of, first panel 12 and second panel 14 include an array of cavities 50 extending from a respective one of interior surfaces 38 and 48 into first panel 12 and/or second panel 14 toward a respective one of exterior surfaces 36 and 46. Each of the array of cavities 50 is similarly shaped and slightly larger in size as compared to one of fixed magnets 52. As such, where each of fixed magnets 52 are one of rectangular or circular, each of the array of cavities 50 is one of rectangular and circular, respectively.

Each fixed magnet 52 is adhered or otherwise secured to the at least one of first panel 12 and second panel 14 to fit largely, for example, to fit more than 85% of its mass, in a different one of the cavities 50. In this way, the array of fixed magnets 52 is formed. In one example, the arrow of cavities 50, and therefore of magnets is formed to accommodate common paper sizes such as letter size (8½ inch by 11 inch) or any other paper size. More specifically, in one embodiment, the array of cavities 50 and fixed magnets 52 are arranged with four of the cavities and fixed magnets 52 being positioned just inside an expected footprint of one of documents 110, and similar groups of four magnets being sequentially positioned side by side by as many as a size of the at least one of the first panel 12 and the second panel 14 allows. That is, a first four fixed magnets 52 are positioned to be inside and near corners of an 8½-inch by 11-inch footprint of one of documents 110 (see also FIG. 7). Other arrangements of the array of cavities 50 and the array of fixed magnets 52 are also contemplated and will be apparent to those of skill in the art upon reading the present application.

Binding member 16 is formed as a single fabric strip of a flexible yet strong material, according to one embodiment. Binding member 16 is an elongated strip of fabric and defines longitudinal edges 70 positioned opposite each other with each other and lateral edges 72 positioned opposite each other and each extending between longitudinal edges 70, in one embodiment. Longitudinal edges 70 may extend substantially parallel to each other and/or lateral edges 72 may extend substantially parallel to each other. Binding member 16 defines an interior surface 74, extending between and largely bound by longitudinal edges 70 and lateral edges 72, and an exterior surface 76, extending between and largely bound by longitudinal edges 70 and lateral edges 72 and facing in an opposite direction as interior surface 74.

Figure 2A:
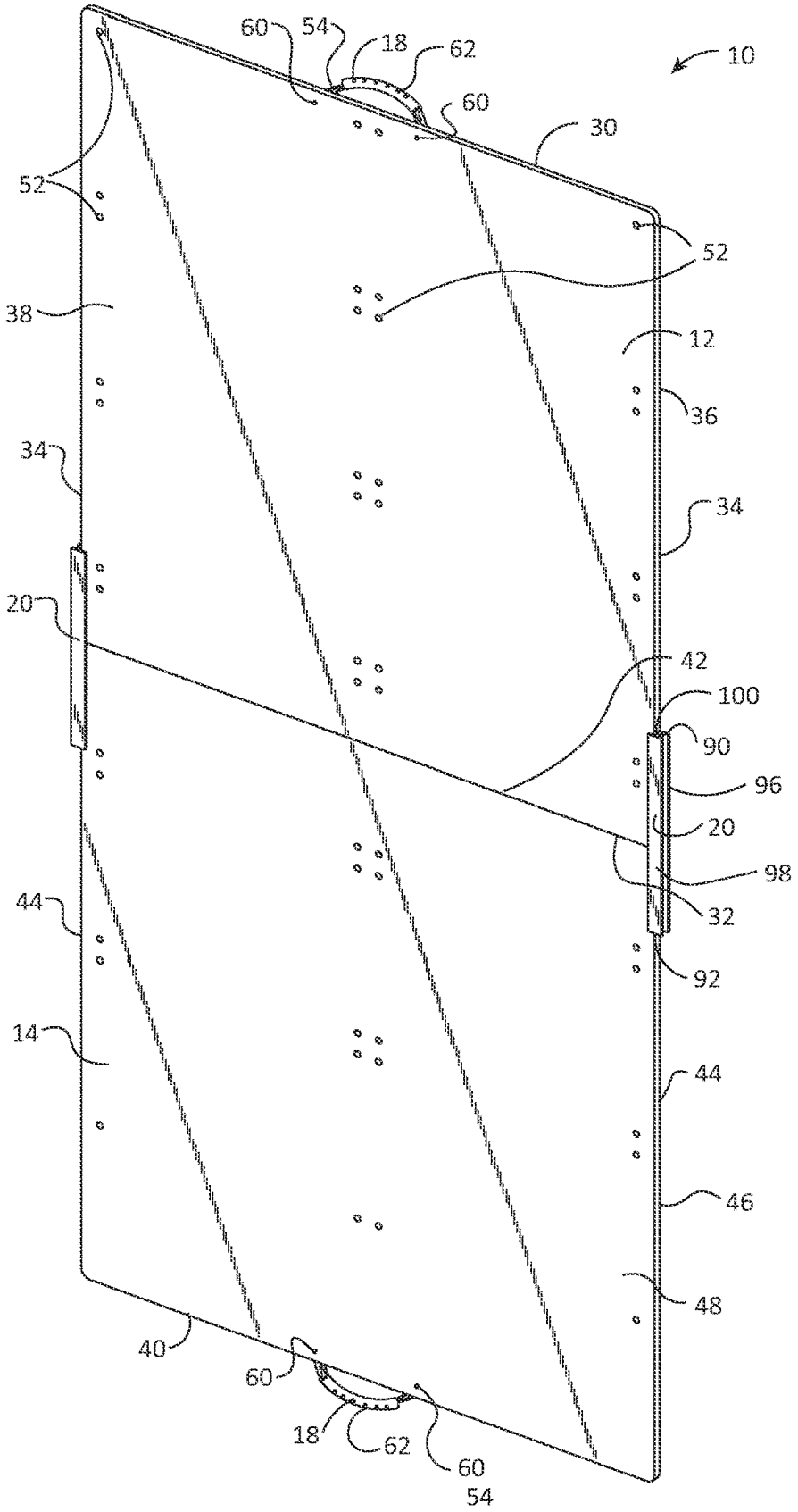
FIG. 2A is a front perspective view illustration of the foldable, presentation portfolio system in a secured and unfolded position, according to one embodiment of the present invention.
Figure 2B:
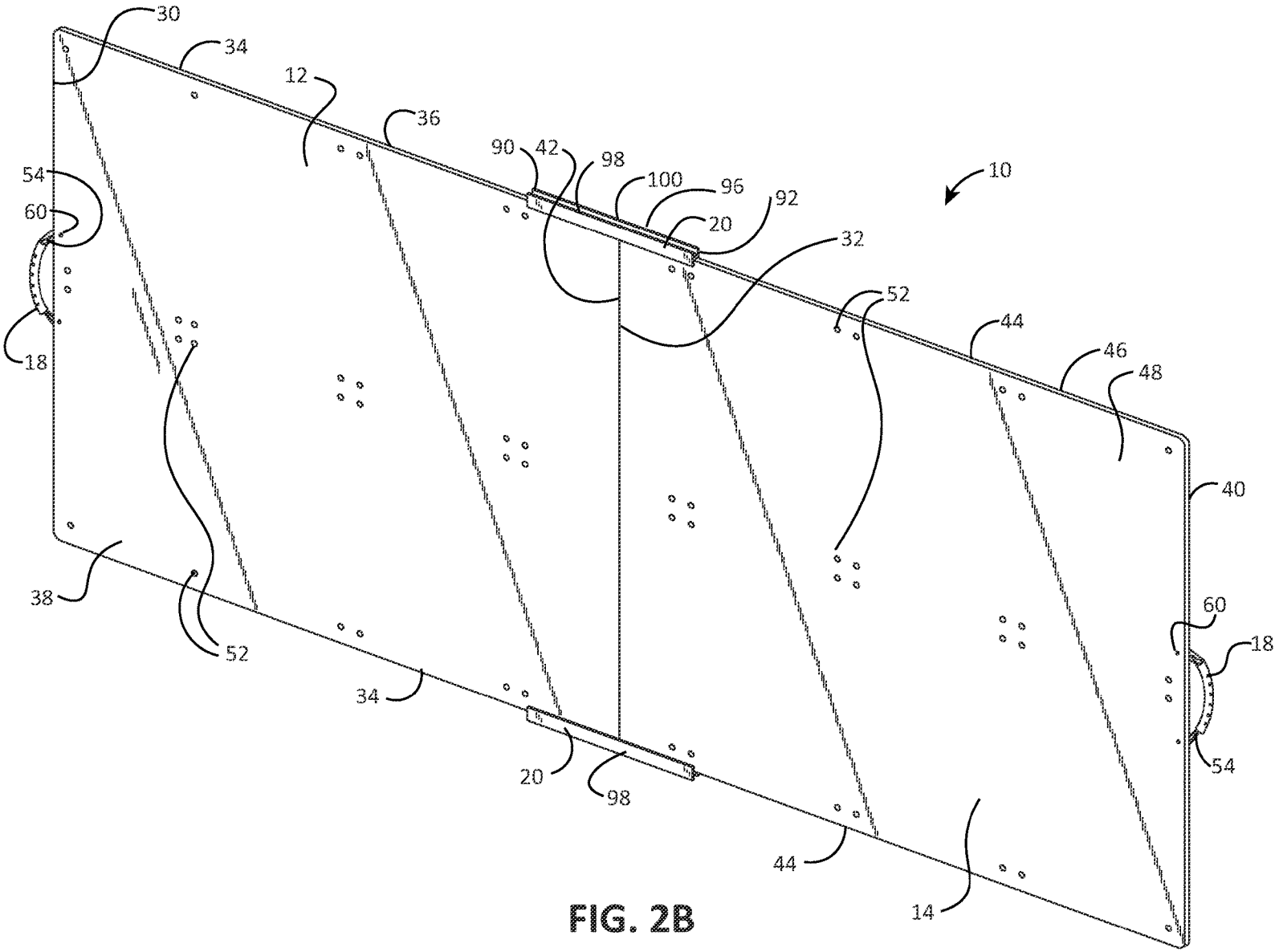
FIG. 2B is a front perspective view illustration of the foldable, presentation portfolio system in a secured and unfolded position and rotated as compared to FIG. 2A for display, according to one embodiment of the present invention.
Figure 3:
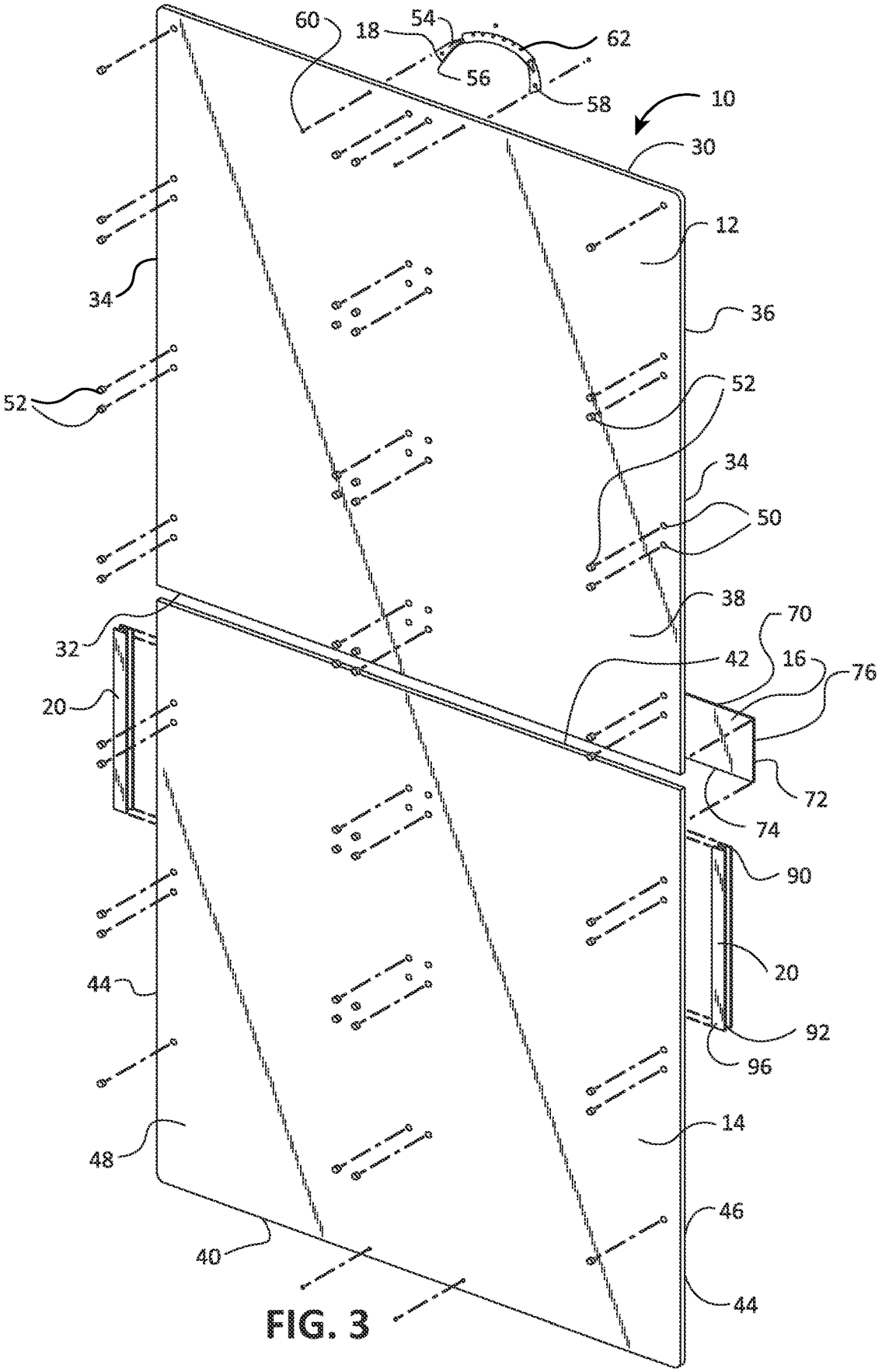
FIG. 3 an exploded, front perspective view illustration of the foldable, presentation portfolio system in an unfolded position, according to one embodiment of the present invention.
Figure 4:
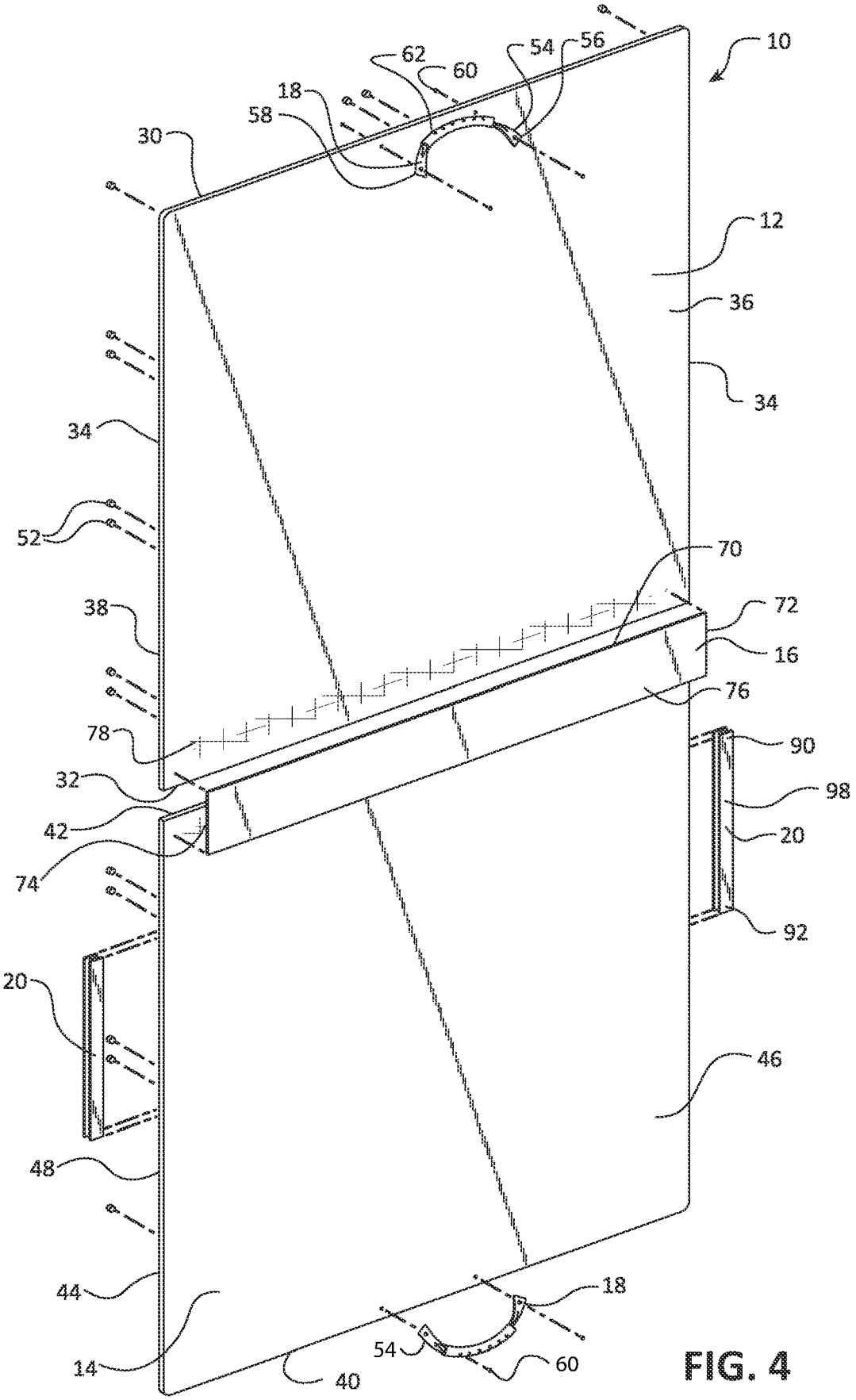
FIG. 4 an exploded, rear perspective view illustration of the foldable, presentation portfolio system in an open position, according to one embodiment of the present invention.
Figure 5:
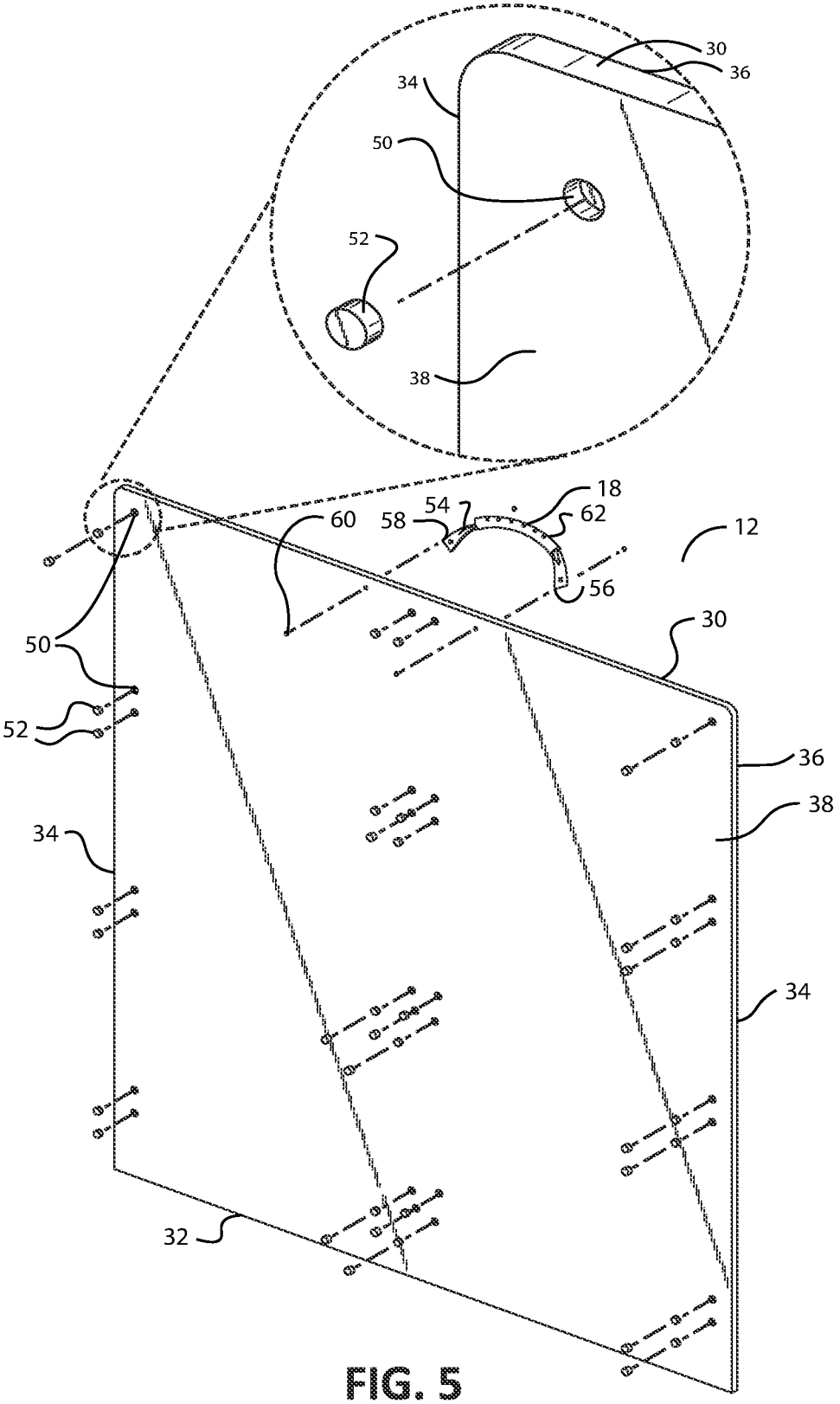
FIG. 5 is an exploded, front perspective view illustration with enlarged detail of a first panel, magnets, and handle of the foldable, presentation portfolio system of FIG. 1, according to one embodiment of the present invention.

Referring to FIG. 4, interior surface 74 of binding member 16 is securely coupled to a length of exterior surface 36 of first panel 12 near bound lateral edge 32 and to a length of exterior surface 46 of second panel 14 near bound lateral edge 42. In one example, binding member 16 is coupled to first panel 12 and second panel 14 via adhesive 78. More specifically, in one embodiment, binding member 16 is of sufficient width between lateral edges 72 that, even when binding member 16 is laid flat, that is, extends substantially planarly, bound lateral edge 32 of first panel 12 and bound lateral edge 42 of second panel 14 extends substantially parallel to one another and spaced apart from one another. Bound lateral edge 32 of first panel 12 and bound lateral edge 42 of second panel 14 are spaced from each other a distance equal to or greater than a thickness of first panel 12 added to a thickness of second panel 14 to allow first panel 12 and second panel 14. As such, first panel 12 from the open position of FIG. 1 can be rotated to from the open position, e.g., as shown in FIGS. 2A and 2B, to the closed position, e.g., as shown in FIG. 1, in which first panel 12 is stacked upon second panel 14 for storage and transportation of any documents 110 secured thereto.

Handles 18 are secured to one or both of first panel 12 and the second panel 14 in one embodiment. Handles 18 or a singular one of handles 18 may be used with or without any other member or device to selectively holding first panel 12 and second panel 14 adjacent to and stack upon one another. While various forms of handles 18 can be used and will be understood by those of skill in the art upon reading the application, in one embodiment, each handle 18 includes a handle strap 53 of elongated form extending from a first end 56 to a second end 58. First end 56 and second end 58 are each separately secured to the respective one of first panel 12 and second panel 14 via a coupling means 60 such as a rivet, screw, staple, etc. to form a loop sized to allow a user to grasp handle 18 with at least four fingers fitting through a space created between handle 18 and the one of the first panel 12 and the second panel 14. In one example, a tubular like cover 62 extends around a part of the handle strap 53 to make strap more ergonomic and/or comfortable for a user to grasp and carry. Cover 62 may be formed of any suitable material, such as plastic, leather, fabric, etc.

Figure 6:
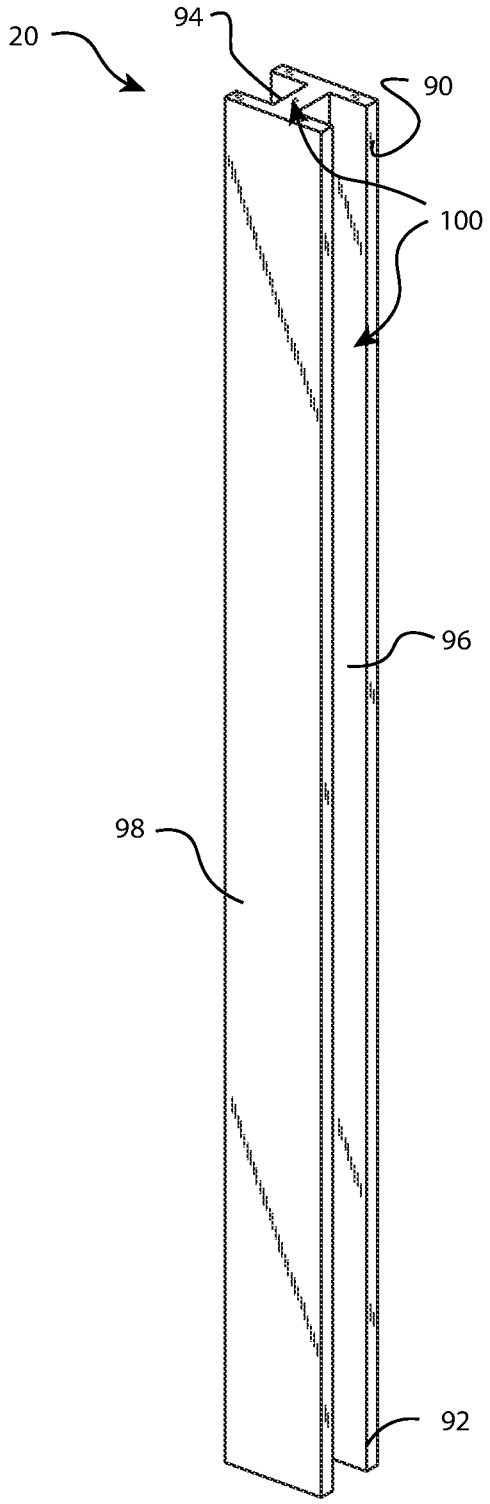
FIG. 6 is a front perspective view illustration of a locking bar of the foldable, presentation portfolio system of FIG. 1, according to one embodiment of the present invention.

Each locking member 20 is similarly formed and shaped with one locking member 20 configured to selectively receive two selectively linearly aligned ones of opposite side edges 34 of first panel 12 and opposite side edges 44 of second panel 13, and the other locking member 10 the other two selectively linearly aligned ones of opposite side edges 34 of first panel 12 and opposite side edges 44 of second panel 13. Locking member 20 is more specifically configured to selectively be secured along one of both of side edges 34 and 44 and to slide along those same side edges 34 and 44. Referring to the view of locking member 20 in FIG. 6, in one embodiment, locking member 20 is substantially elongated defining and extending between a first end 90 and second end 92.

Locking member 20 further comprises a web 84, a first flange 96, and a second flange 98. Web 84 is substantially planar and extends front to back in a direction perpendicular to the elongated extension of locking member 20. The first flange 96 extends in a plane substantially perpendicularly to the web 84 along a longitudinal side thereof, and second flange 98 extends in a plane substantially parallel to first flange 96 opposite second flange 98. Locking member 20 defines an elongated channel 100 on one side of web 84, bound by first flange 96 and second flange 98, and open on a side opposite web 84. In one example, a second elongated channel 100 is formed on an opposing side of web 84 also bound by first flange 96 and second flange 98, and open on a side opposite web 84.

Figure 9:
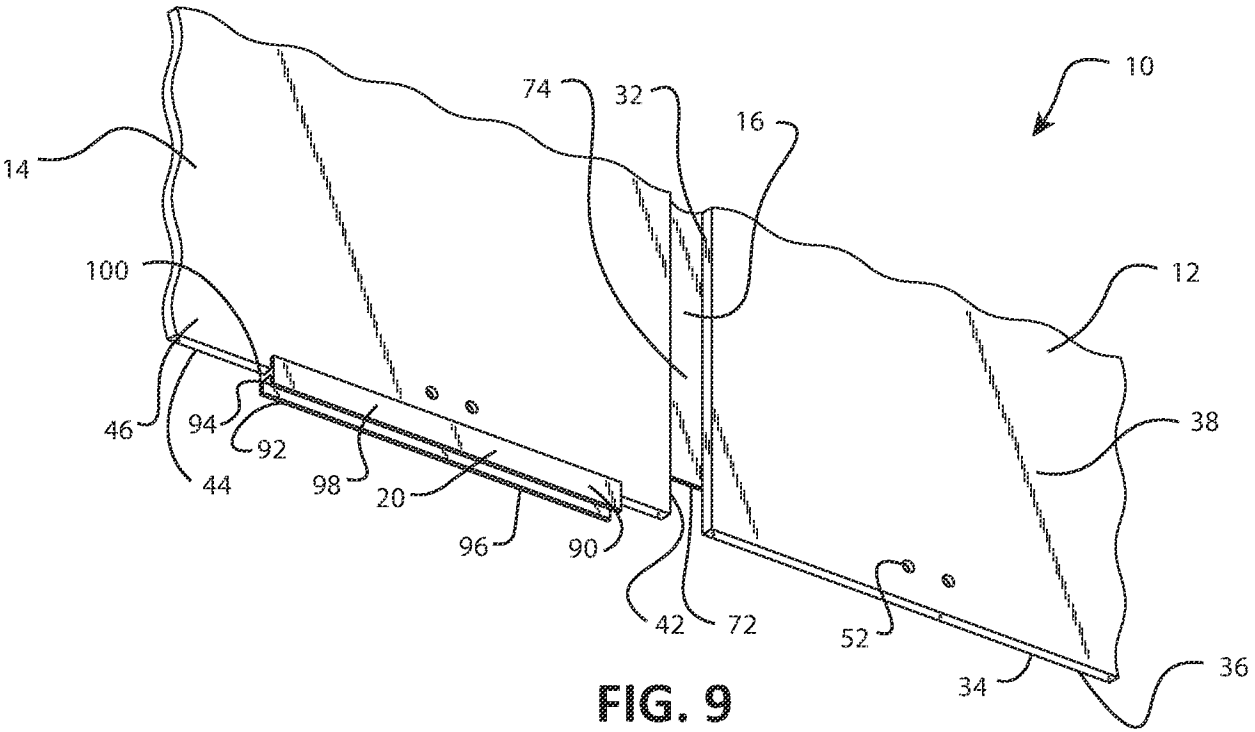
FIG. 9 is a front, perspective view illustration of a portion of the foldable presentation system of FIG. 1 in an unsecured, unfolded position, according to one embodiment of the present invention.
Figure 10:
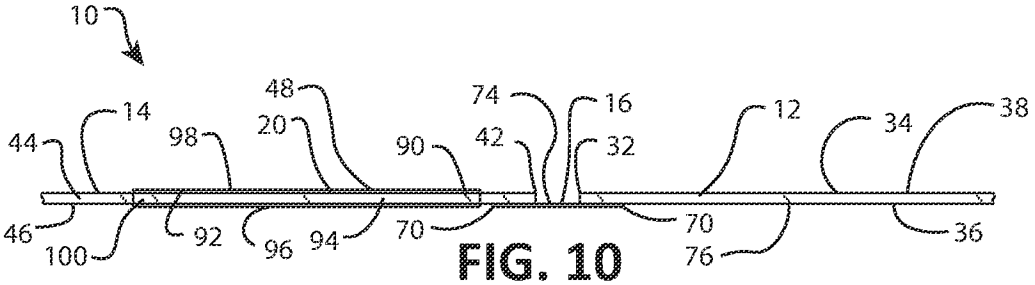
FIG. 10 is a bottom view illustration of a portion of the foldable presentation system of FIG. 1 in an unsecured, unfolded position, according to one embodiment of the present invention.

Each locking member 20 is placed on one of opposite side edges 34 of first panel 12 or one of opposite side edges 44 of second panel 14, for example, as illustrated in the close up view of FIGS. 9 and 10, on one of side edges 44 of second panel 14. Elongated channel 100 is sized and shaped to snuggly receive second panel 14 via compression between first flange 96 and second flange 98 with sufficient strength to allow locking member 20 to stay attached to second panel 14, but sufficiently light in compression to allow locking member 20 to be slid along side edge 44 when urged on via intentional force from a user.

When locking member 20 is coupled with only one of first panel 12 and second panel 14, first panel 12 and second panel 14 can be spaced from each other as shown in FIGS. 9 and 10. When first panel 12 and second panel 14 are so spaced, first panel 12 and second panel 14 are rotatable toward one another about binding member 16 to lay on top of one another in the same footprint, e.g., as illustrated in FIG. 1 with the portion of binding member 16 between first panel 12 and second panel 14 being sufficient to accommodate the thickness of both first panel 12 and second panel 14.

Figure 7:
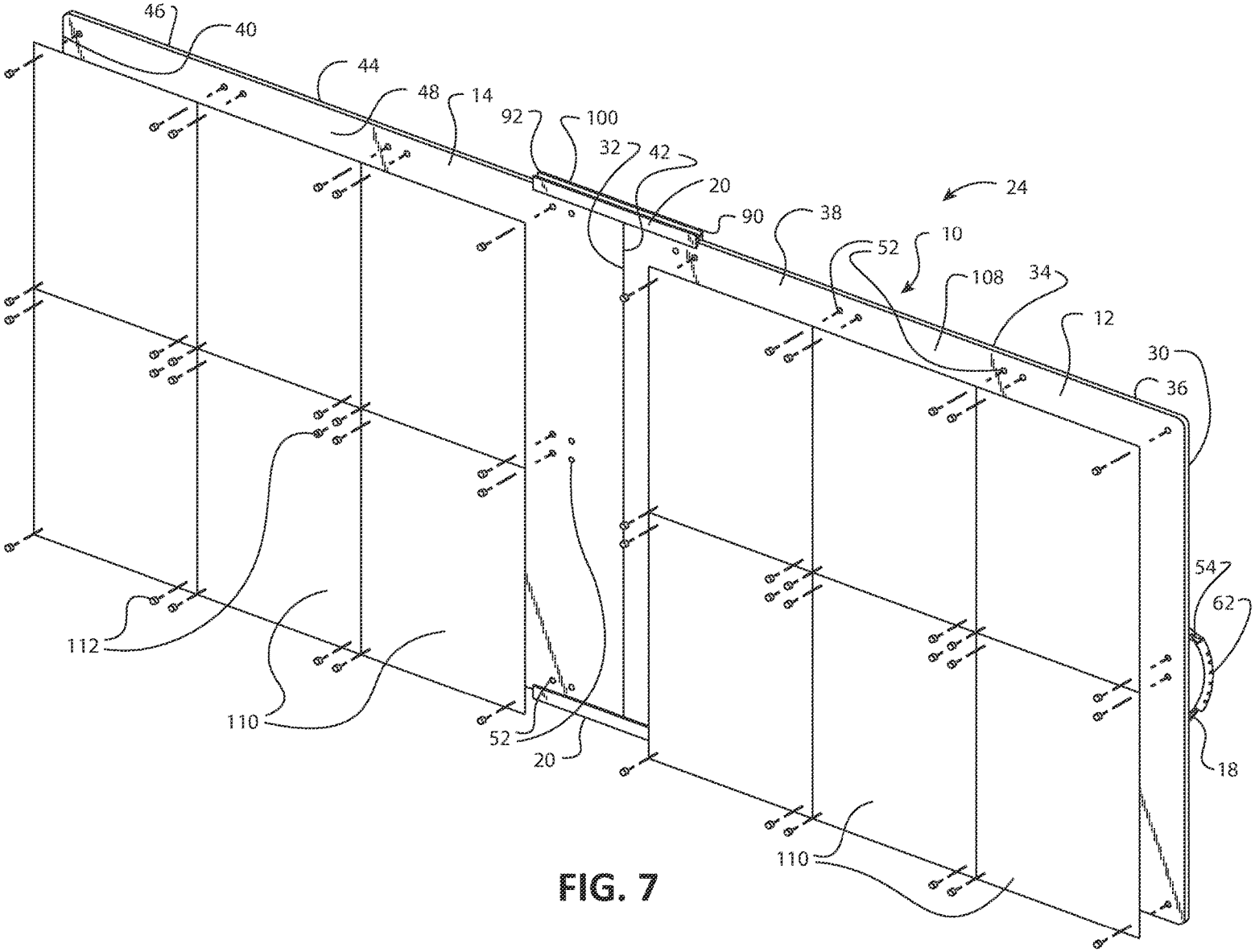
FIG. 7 is a tilted, front perspective view illustration of the foldable, presentation portfolio system in an open position with display items attached thereto with magnets, according to one embodiment of the present invention.
Figure 11:
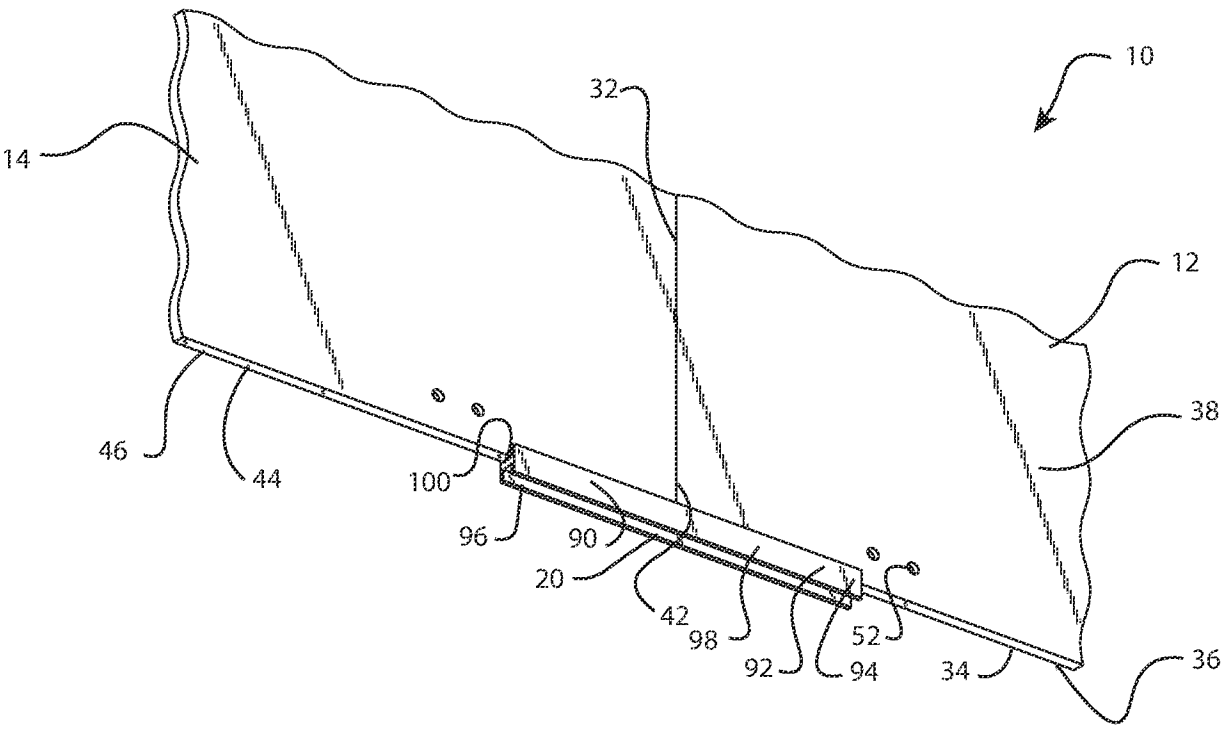
FIG. 11 is a front, perspective view illustration of a portion of the foldable presentation system of FIG. 1 in a secured, unfolded position, according to one embodiment of the present invention.
Figure 12:
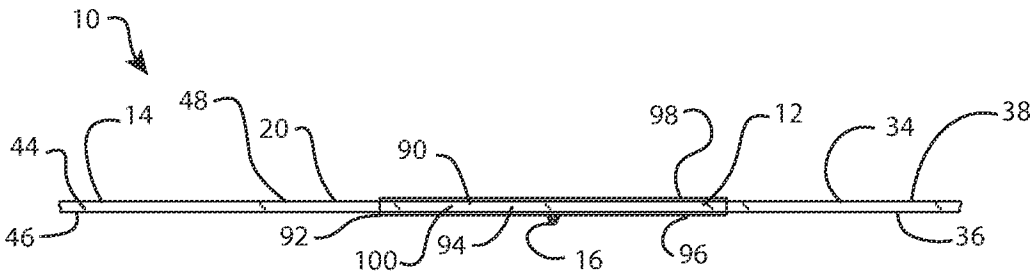
FIG. 12 is a bottom view illustration of a portion of the foldable presentation system of FIG. 1 in a secured, unfolded position, according to one embodiment of the present invention.

Locking member 20 is further slidable toward first panel 12 to engage both one side edge 44 of second panel 14 and one side edge 34 of first panel 12 as illustrated, for example, in FIGS. 7, 11, and 12. In one embodiment, before so sliding locking member 20, first panel 12 and second panel 14 are pushed toward one another, for example, to be adjacent one another or, even more particularly, to abut bound lateral edge 32 of first panel 12 with bound lateral edge 42 of second panel 14, such that binding member 16 bunches or folds upon itself beyond exterior surfaces 36 and 46 of first and second panel as best shown in FIG. 12. Notably, lateral edges 72 of binding member 16 each stop short of extending all the way to opposing side edges 34 and 44, so as to allow and not impede slidable movement of locking member 20 from first panel 12 onto second panel 14 to hold or lock the first panel 12 and the second panel 14 in a coplanar arrangement, specifically, aligning the interior surfaces 38 and 48 thereof to collectively form a presentation surface 108 as shown, for example, in FIG. 7.

In one example, locking member 20 is one of two locking member 20 each placed to interface with a different pair of one of opposing side edges 34 and one of opposing side edges 44. In this manner, placing both locking members 20 to each straddle both bound lateral edges 34 and 44 to receive a portion of each of first panel 12 and second panel 14 further secures presentation portfolio in the secured position of the open orientation providing a relative stiff large presentation surface as illustrated with reference to FIG. 7, for example.

Documents or other presentation items 110 can be secured to one or both of interior surfaces 38 and 48 by placing a portion of each presentation item 110 over one of the array of fixed magnets 52 affixed to one of first panel 12 and second panel 14 and then placing one of a plurality of free magnets 112 over the presentation item 110 to align with the corresponding one of the array of fixed magnets 52 to magnetically hold or partially hold presentation item 110 in place. In one example, multiple pairs of fixed magnets 52 and free magnets 112 are used to hold a single presentation item 110 in place, for instance, as illustrated in FIG. 7, where a different pair of one of fixed magnets 52 and one of free magnets 112 aligns with and is used at each corner of presentation item 110, such as a piece of paper letter or otherwise sized to coordinate with the layout of the array of fixed magnets 52 as will be apparent to those of skill in the art upon reading the currently application. When documents 110 are so secured, during use for presentation or other viewing, presentation portfolio 10 can be stood on a floor, table, easel, ledge, or any other supporting surface (not shown) in a substantially vertical position, such that bottom ones of the opposite longitudinal edges 34 and 44 of the first panel 12 and the second panel 14, respectively, are placed on the supporting surface.

Following use of presentation portfolio 10, one or more of locking members 20 is slid away from its secured position extending across the abutting intersection of first panel 12 and second panel 14, that is, across, bound lateral edges 32 and 42, to only receive one of bound lateral edges 32 and 42. Movement of locking member(s) 20 allows presentation portfolio 10 to be closed by rotating first panel 12 relative to second panel 14, or vice versa, about flexible binding member 16.

Figure 8:
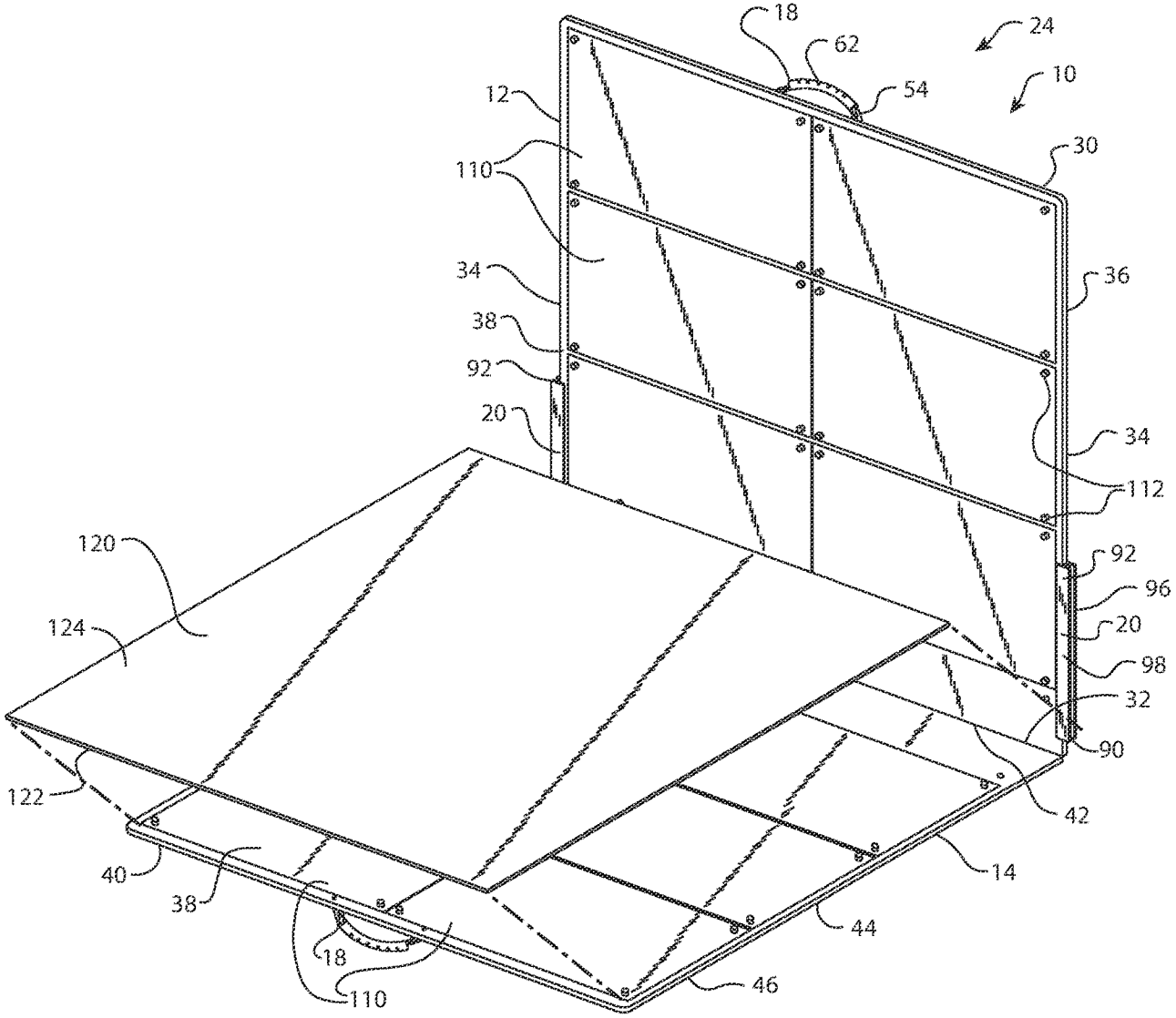
FIG. 8 is a front perspective view illustration of the foldable, presentation portfolio system in a partially folded position and including a separation board, according to one embodiment of the present invention.

In one example, as illustrated in FIG. 8, presentation portfolio 10 additionally includes a divider panel 120, which is substantially planar and has an overall footprint or shape substantially identical to, that is identical to or just slightly smaller than, first panel 12 and second panel 14. Divider panel 120 is placed over documents 110 on one of first panel 12 and second panel 14, such that as first panel 12 and second panel 14 are rotated toward one another to move presentation portfolio 10 into a closed orientation, divider panel 120 is interposed between first panel 12 and second panel 14. In one example, divider panel 120 services one or more purposes, such as to prevent bleeding of any parts of documents 110 secured to one of first panel 12 and 14 to documents 110 secured to the other of first panel 12 and second panel 14, to prevent any of the array of free magnets 112 from indenting either documents 110 on an opposite one of first panel 12 and 14 or the opposite one of first panel 12 and second panel 14 themselves, and/or to prevent undesired magnetic coupling between ones of the free magnets 112 or the array of fixed magnets 42 on one of first panel 12 and second panel 14 with ones of the free magnets 112 or the array of fixed magnets 42 on the other one of first panel 12 and second panel 14.

Rotation of first panel 12 relative to second panel 14 results in first panel 12 being stacked or positioned substantially coplanar with second panel 14, with interior surface 38 of first panel 12 facing interior surface 48 of second panel 14 and vice versa and the overall footprints of first panel 12 and second panel 14 being aligned. Notably, in one embodiment, the flexible nature of binding member 16 allows first panel 12 and second panel 14 to abut, for example, immediately abut, one other along bound lateral edges 32 and 42 when desired, for example, in the open orientation, and to be spaced apart from one another, while still being coupled to one another, for folding into the closed orientation shown in FIG. 1. When in the closed position, presentation portfolio is readily carried or transported by a user via grasping only the two handles 18. In one example, where only one handle 18, an additional feature is preferably added to hold first panel 12 and second panel 14 against each other when presentation portfolio 10 is in the closed position to decrease the likelihood that any documents 110 or portions of presentation portfolio 10 will be inadvertently lost during transport of presentation portfolio system 24 to another location.

Although the invention has been described with respect to meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A presentation portfolio comprising:

a first panel being substantially planar and defining a first panel interior surface and a first panel longitudinal edge extending along a side of the first panel interior surface;

a second panel being substantially planar and defining a second panel interior surface and a second panel longitudinal edge extending along a side of the second panel interior surface;

a binding member rotatably coupling the first panel with the second panel such that the presentation portfolio is movable between an open orientation, in which the first panel and the second panel are positioned to be coplanar with one another, and a closed orientation, in which the first panel and the second panel are stacked on one another such that the first panel interior surface faces the second panel interior surface; and a locking member defining a first end, a second end opposite the first end, and an elongated channel extending between and through the first end and the second end, the locking member is initially slidably coupled to the first panel by receiving a first portion of the first panel longitudinal edge within the elongated channel;

wherein when the presentation portfolio is in the open orientation, the locking member is slidable between an unsecured position, in which the locking member maintains the first portion of the first panel longitudinal edge and is spaced entirely from the second panel, and a secured position, in which the elongated channel maintains a second, smaller portion of the first panel longitudinal edge and a first portion of the second panel longitudinal edge of the second panel, which is positioned to linearly align with the first panel longitudinal edge, in a manner selectively maintaining the first panel in a position directly adjacent the second panel.

2. The presentation portfolio of claim 1, wherein when the presentation portfolio is in the unsecured position of the open orientation, the first panel and the second panel are laterally spaced apart a distance equal to a least a thickness of the first panel added to a thickness of the second panel.

3. The presentation portfolio of claim 2, wherein when the presentation portfolio is in the secured position of the open orientation, the first panel and the second panel abut one another.

4. The presentation portfolio of claim 3, wherein:

the first panel defines a first panel bound edge extending perpendicularly to the first panel longitudinal edge along a side of the first panel, the second panel defines a second panel bound edge extending perpendicularly to the second panel longitudinal edge along a side of the second panel, the binding member is coupled to the first panel to extend across the first panel bound edge and is coupled to the second panel to extend across the second panel bound edge, and in the secured position of the open orientation, the first panel and the second panel abut each other along at least a majority of a length of each of the first panel bound edge and the second panel bound edge.

5. The presentation portfolio of claim 4, wherein the binding member is folded upon itself when the presentation portfolio is in the secured position of the open orientation.

6. The presentation portfolio of claim 4, wherein:

the first panel defines a first panel exterior surface opposite to and facing away from the first panel interior surface, the second panel defines a second panel exterior surface opposite to and facing away from the second panel interior surface, and the binding member is secured directly to each of the first panel exterior surface and the second panel interior surface along a respective one of the first panel bound edge and the second panel bound edge.

7. The presentation portfolio of claim 6, wherein the binding member is formed of a flexible, planar textile material.

8. The presentation portfolio of claim 7, wherein the binding member is coupled to each of the first panel and the second panel via adhesive.

9. The presentation portfolio of claim 1, wherein:

the first panel defines a first panel exterior surface opposite to and facing away from the first panel interior surface, the locking member defines:

a web extending in a direction parallel to the first panel longitudinal edge, a first flange extending from one side of the web in a direction substantially perpendicular to the web and parallel to the first panel interior surface, and a second flange extending from an opposite side of the web in a direction substantially perpendicular to the web and parallel to the first panel exterior surface such that the elongated channel is formed between the first flange and the second flange on the one side of the web, and the locking member is slidably coupled to the first panel via friction fit on the first panel such that the web is positioned adjacent the first panel longitudinal edge, the first flange contacts the first panel interior surface, and the second flange contacts the first panel exterior surface.

10. The presentation portfolio of claim 1, wherein:

the first panel defines a first panel exterior surface, which is opposite to and faces away from the first panel interior surface, and a first panel free edge, which extends along a side of the first panel opposite the binding member perpendicularly to the first panel longitudinal edge, and the presentation portfolio defines a handle secured to the first panel and extending from the exterior surface of the first panel to assist a user in carrying the presentation portfolio.

11. The presentation portfolio of claim 1, in combination with documents magnetically secured to at least one of the first panel interior surface and the second panel interior surface.

12. The presentation portfolio of claim 1, further comprising:

a plurality of free magnets, wherein:

at least one of the first panel and the second panel includes a plurality of fixed magnets at least partially embedded into a corresponding one of the first panel and the second panel and being exposed at a corresponding one of the first panel interior surface and the second panel interior surface, and each of the plurality of free magnets is magnetically and selectively secured to at least one of the first panel and the second panel via magnetic coupling with a different one of the plurality of fixed magnets in a manner configured to hold documents between resulting pairs of one of the plurality of free magnets and one of the plurality of fixed magnets.

13. The presentation portfolio of claim 12, in combination with documents magnetically secured to at least one of the first panel interior surface and the second panel interior surface via ones of the resulting pairs of one of the plurality of fixed magnets and one of the plurality of free magnets.

14. The presentation portfolio of claim 1, wherein the first panel and the second panel are formed of a non-magnetic material.

15. The presentation portfolio of claim 14, wherein the non-magnetic material is one of foam core material, a paperboard material, and a cardboard material.

16. The presentation portfolio of claim 1, further comprising:

a dividing panel being planar and shaped substantially identically to each of the first panel and the second panel, wherein the dividing panel is interposed between the first panel and the second panel when the presentation portfolio is in the closed orientation.

17. The presentation portfolio of claim 11, wherein the first panel, the second panel, and the dividing panel are each formed of a non-magnetic material.

18. The presentation portfolio of claim 16, in combination with a first set of documents secured to the first panel and a second set of documents secured to the second panel, and the dividing panel separates first set of documents from the second set of documents when the presentation portfolio is in the closed position.

19. The presentation portfolio of claim 1, wherein:

the locking member is a first locking member, the presentation portfolio includes a second locking member defining a second member elongated channel extending along an entire length of the second locking member, wherein when the presentation portfolio is in the open orientation, the second locking member is slidable between an unsecured position along one of the first panel opposite the first locking member and the second panel opposite the second panel longitudinal edge spaced entirely from the other one of the first panel and the second panel, and a secured position simultaneously secured along both of the first panel opposite the first locking member and the second panel opposite the second panel longitudinal edge further selectively holding the first panel and the second panel adjacent one another.

20. A presentation portfolio system comprising:

a presentation portfolio including:

a first panel being substantially planar and defining a first panel interior surface and a first panel longitudinal edge extending along a side of the first panel interior surface, the first panel including a plurality of fixed magnets at least partially embedded into the first panel and exposed at the first panel interior surface, a second panel being substantially planar and defining a second panel interior surface and a second panel longitudinal edge extending along a side of the second panel interior surface, a binding member rotatably coupling the first panel with the second panel such that the presentation portfolio is movable between an open orientation, in which the first panel and the second panel are positioned to be coplanar with one another, and a closed orientation, in which the first panel and the second panel are stacked on one another such that the first panel interior surface faces the second panel interior surface, a locking member defining a first end, a second end opposite the first end, and an elongated channel extending between and through the first end and the second end, the locking member is initially slidably coupled to first panel by receiving a portion of the first panel longitudinal edge within the elongated channel, a plurality of free magnets each being magnetically coupled with a different one of the plurality of fixed magnets; and a plurality of documents, each document being selectively secured to one of the first panel interior surface and the second panel interior surface magnetically by being interposed between of the plurality of fixed magnets and a corresponding one of the plurality of free magnets;

wherein when the presentation portfolio is in the open orientation, the locking member is slidable between an unsecured position, in which the locking member maintains the first panel longitudinal edge and is spaced entirely from the second panel, and a secured position, in which the elongated channel maintains a smaller portion of the first panel longitudinal edge and a portion of the second panel longitudinal edge of the second panel, which is positioned to linearly align with the first panel longitudinal edge, in a manner selectively holding the first panel in a position adjacent the second panel.

* * * * *